US010059030B2

(12) United States Patent
Oldorff

(10) Patent No.: US 10,059,030 B2
(45) Date of Patent: Aug. 28, 2018

(54) METHOD FOR PRODUCING DECORATED WOODEN COMPOSITE BOARDS AND PANEL PRODUCED FROM THE WOODEN COMPOSITE BOARD, IN PARTICULAR FLOOR PANEL, AND USE OF A WOODEN COMPOSITE BOARD PRODUCED ACCORDING TO THE METHOD

(71) Applicant: FLOORING TECHNOLOGIES LTD., Pieta (MT)

(72) Inventor: Frank Oldorff, Schwerin (DE)

(73) Assignee: FLOORING TECHNOLOGIES LTD., Kalkara (MT)

( * ) Notice: Subject to any disclaimer, the term of this patent is extended or adjusted under 35 U.S.C. 154(b) by 0 days.

(21) Appl. No.: 15/302,809

(22) PCT Filed: May 8, 2015

(86) PCT No.: PCT/EP2015/000942
§ 371 (c)(1),
(2) Date: Dec. 28, 2016

(87) PCT Pub. No.: WO2015/169450
PCT Pub. Date: Nov. 12, 2015

(65) Prior Publication Data

US 2017/0120474 A1 May 4, 2017

(30) Foreign Application Priority Data

May 9, 2014 (EP) ..... 14001642

(51) Int. Cl.

| | |
|---|---|
| ***B27N 7/00*** | (2006.01) |
| ***B27N 3/02*** | (2006.01) |
| ***B27N 3/04*** | (2006.01) |
| ***B27N 3/08*** | (2006.01) |

(52) U.S. Cl.
CPC ..... *B27N 7/005* (2013.01); *B27N 3/02* (2013.01); *B27N 3/04* (2013.01); *B27N 3/08* (2013.01)

(58) Field of Classification Search
CPC ..... B27N 7/005
USPC ..... 428/99
See application file for complete search history.

(56) References Cited

U.S. PATENT DOCUMENTS

| | | | | |
|---|---|---|---|---|
| 3,847,646 | A * | 11/1974 | Daunheimer | B05D 1/40 427/368 |
| 8,512,804 | B2 | 8/2013 | Oldorff | |
| 2009/0252925 | A1 | 10/2009 | Provoost et al. | |
| 2013/0177742 | A1 | 7/2013 | Siebert et al. | |
| 2013/0305649 | A1 | 11/2013 | Thiers | |
| 2015/0152651 | A1 | 6/2015 | Siebert et al. | |
| 2015/0283849 | A1 | 10/2015 | Oldorff | |

FOREIGN PATENT DOCUMENTS

| | | | |
|---|---|---|---|
| DE | 19532819 | 3/1997 | |
| DE | 19751115 | 5/1999 | |
| DE | 102010025543 | 11/2011 | |
| EP | 1454763 | 9/2004 | |
| EP | 2108524 | 10/2009 | |
| EP | 2338693 | 6/2011 | |
| EP | 2730430 | 5/2014 | |
| EP | 2762328 | 8/2014 | |
| WO | WO-2012037950 | 3/2012 | |
| WO | WO-2012037950 A1 * | 3/2012 | B44C 5/043 |
| WO | WO-2013165307 | 11/2013 | |

* cited by examiner

*Primary Examiner* — Brent T O'Hern
(74) *Attorney, Agent, or Firm* — Andrew M. Calderon; Roberts Mlotkowski Safran Cole & Calderon, P.C.

(57) ABSTRACT

A method for producing an impregnated article comprising a cellulose layer which is impregnated with a melamine resin in order for a core impregnation to be formed is characterized in that a layer of a liquid medium having a moiety of isocyanate groups is applied to the top face and/or the bottom face of the core-impregnated cellulose layer.

19 Claims, No Drawings

METHOD FOR PRODUCING DECORATED WOODEN COMPOSITE BOARDS AND PANEL PRODUCED FROM THE WOODEN COMPOSITE BOARD, IN PARTICULAR FLOOR PANEL, AND USE OF A WOODEN COMPOSITE BOARD PRODUCED ACCORDING TO THE METHOD

1. Field of the Invention

The invention relates to a process for the production of a decorated wooden board, and to a panel produced from the wooden board, and also to the use of a wooden board produced by the process.

2. Discussion of Background Information

WO2012/037950 A1 discloses a process for the production of panels with the following steps:

a) scattering of glued wood fibers or wood chips to give a cake of wood material,
b) pressing of the cake of wood material at elevated temperature to give a large-format substrate board which is provided in press-finished condition and, at least on the upper side thereof, has a press skin that arose during production thereof,
c) application of a base coat made of a melamine-based liquid resin to the upper side of the substrate board, where the resin penetrates at least to some extent into the upper peripheral layer of the substrate board and at least to some extent penetrates into, and improves the quality of, the region of the press skin,
d) drying of the base coat layer,
e) application of a base color to the base coat layer,
f) drying of the base color,
g) in order to produce a decorative effect, application of at least one water-based printing ink enriched with coloring pigments to the dried base color,
h) drying of the decorative effect,
i) application, to the decorative layer, of a sealing system made of at least one melamine-based resin,
j) drying of the sealing system,
k) pressing of the substrate board with the base coat that has been applied on an upper side, the base color, the decorative effect, and the sealing system, and also with a counterbalancing material that has been applied to an underside, with exposure to pressure and heat, to form a laminate.

WO 2013/165307 A2 discloses a process for the production of a decorative wooden board where, as is also the case in the abovementioned document, a primer is applied to the upper side of the wooden board before ink is applied. An aqueous solution comprising at least one metal salt can be used as primer. The primer is applied to the upper side by means of a digital printer. An aqueous ink is then applied to the primer layer.

EP 1 454 763 A2 discloses a process for the finishing of a wood-based board, in particular MDF or HDF with an upper side and an underside, where a sealing layer made of melamine resin is first applied to the upper side of the board, a decorative effect is printed onto the sealing layer, and then a protective layer made of melamine resin is applied to the decorative effect. The board structure is then pressed with exposure to heat until the protective layer and the sealing layer melt and bond to one another with enclosure of the printed decorative effect.

DE 195 32 819 A1 discloses a process for the production of a wooden board with a surface that can be provided with an optical effect, where a base coloring, a sealing system, a print base, and a printed decorative effect are applied in succession on the wooden board. The print base here is composed of a base coloring, or a base coat of a lacquer sealing system and a surface lacquer. A printed decorative effect can be applied by way of example in a two-color print to the print base by means of gravure cylinders. A multilayer acrylate UV lacquer which can be cured by means of UV light can finally be applied to said print.

DE 197 51 115 A1 discloses a process for the coating of a panel where at least one ink layer is applied to the surface by means of a printing process, in particular by means of screening printing. This surface can be an untreated, ground or pretreated, in particular lacquered, surface. The ink layer applied can finally be covered by a clear lacquer coating.

Primer used comprises an aqueous melamine resin which is applied in a plurality of layers to the base coat. Said primer comprises from 40% to 50% of water, which in turn has to be removed from the material by drying after the application process. The individual primer layers applied have to be thin. Before the next layer is applied, the layer previously applied has to be dried. Up to four layers have to be applied in order to give a uniform primer layer which can be used as base for the subsequent printed decorative effect. Since each layer applied has to be dried, a dryer unit has to be provided downstream of the application equipment.

The drying process usually uses infrared sources. Energy consumption for these is very high, a very large amount of space is required for the dryer units, and the capital expenditure associated therewith is very high.

The aqueous melamine resin is conveyed from a container to an applicator roll, from which excess resin is stripped and returned to the container. The thin primer layer is then applied to the base coat by way of the roll. The melamine resin of the primer comes into contact with the atmosphere, and becomes encrusted over the course of time.

The applicator assembly with its ingoing lines and outgoing lines requires regular cleaning. For this, the plant has to be shut down and dismantled. The applicator assembly is cleaned manually. Cleaning periods provided in a conventional manufacturing plant are about three hours twice per week and 24 hours once per month. During this time, the entire coating plant is inactive, and about 10 people are required to clean four applicator assemblies, in order that the plant can be restarted after 24 hours.

Personnel cost associated with the maintenance operations is likewise very high, as explained above. Another factor rendering conduct of the process more difficult is that the plant has to be run in after each maintenance operation. The running-in of the coating plant after restarting thereof is also time-consuming. The cleaning composition used during cleaning of the applicator assemblies has been contaminated with the primer and, in order to avoid pollution of the environment, requires disposal as special waste, incurring further cost.

The intention is to improve the process disclosed in WO2012/037950 A1, taking these problems into account.

SUMMARY OF THE INVENTION

In order to solve the problems, the invention provides that base color used comprises a water-based ink, and is applied by means of a digital printer to the dried base coat, and that the sealing resin is applied in liquid form.

By designing the process in this way it is possible to use only that quantity of base color that is directly required for the necessary base color layer. There is no requirement for any excess ink that requires stripping, because it is possible to adjust the number of color dots and the quantity of ink used for each color dot. The liquid application of the resin for the sealing layer simplifies the conduct of the process, and the quantity of the resin required can be successfully adjusted and monitored.

It is preferable that an inkjet printer is used as digital printer. Another advantage of the inkjet printer is that it can have an automatic cleaning system for the inkjet nozzles. The inkjet nozzles can be sealed so as to be airtight during the process. Encrustment of the water-based ink is thus avoided. Encrustment in the nozzle can occur only when the inkjet printer is inactive, and said encrustment can quickly be removed by using a solvent. Only a very small quantity of decontaminated liquid arises here.

The base color preferably has white pigmentation, and with particular preference is applied in only a single layer. This markedly reduces introduction of water into the production process, and a single dryer is therefore sufficient to dry the base color layer applied. The capital expenditure required for the manufacturing plant is thus markedly reduced. Almost no manual cleaning is required, and the stoppage times during maintenance of the plant are thus eliminated. There is no longer any requirement for maintenance personnel for cleaning of the plant, and the shortened dryer zone markedly increases the manufacturing time for the wooden board. The overall effect is not only that the production process is simplified but also that its cost is greatly reduced, increasing the competitiveness of the board producer.

The decorative effect can preferably be applied to the base color layer by means of at least one print roll. However, there can also be a plurality of print rolls arranged in series. The decorative effect can also be applied by means of a digital printer, in particular an inkjet printer, and here again it is then advantageous to apply the decorative effect in just a single layer; this also then reduces the extent of the dryer section and the dryer time for the printed decorative effect thus further reducing manufacturing time.

The digital printer is attached above a conveyor belt which transports the wooden board in a direction of transport. In particular when an inkjet printer is used, it is possible to provide a plurality of printing heads with a large number of nozzles, these being arranged in parallel alongside one another. The printing heads can be arranged so as to be stationary, transversely across the transport equipment, or can be moved in oscillating fashion across the board transversely with respect to the transport direction in order to apply the primer and/or the decorative effect.

It is preferable that, as print base for the decorative effect, a primer is applied onto the base color layer. The primer is preferably transparent.

It is preferable that the liquid resin for the base coat and the sealing system is aqueous.

The resin forming the sealing system can have been enriched with abrasion-resistant particles, glass, and/or cellulose.

It is preferable that, during the pressing of the substrate board a surface structure is formed which with particular preference is at least to some extent brought into register with the decorative effect ("synchronous pores").

A panel, in particular a flooring panel, composed of a core made of divided wooden board, produced by the process described above, is characterized by the following features:

a) an upper side, an underside, and two pairs of opposite lateral edges,
b) the upper side and the underside of the core have a press skin which arose during the pressing process,
c) applied at least to the press skin on the upper side, there are the following: a base coat layer, an ink layer composed of a large number of white ink dots, at least one decorative layer and one abrasion-resistant layer,
d) applied on the underside of the core, there are a base coat layer and a layer of counterbalancing material,
e) the base coat layer has penetrated at least to some extent into the press skin on the upper side,
f) on the opposite lateral edges there are connection means and interlocking means provided for connection of a plurality of panels without use of glue.

For the formation of a laminate, the substrate board is preferably pressed, with exposure to pressure and heat, with the base coat applied on an upper side, the base color, the decorative effect, and the sealing system, and also with a counterbalancing material applied on an underside. The values for pressure and temperature here correspond to the values usually used during production of laminate.

The wood board is preferably MDF, HDF, or particle board. It is preferable that there is a transparent primer layer arranged between the ink layer and the decorative layer.

DETAILED DESCRIPTION OF THE PRESENT INVENTION

The process of the invention will be described below.

Glued wood fibers or wooden chips are first scattered to give a cake of wood material. This cake of wood material is then pressed at elevated temperature to give a substrate board which is provided in press-finished condition and, at least on one of the upper sides thereof, has a press skin that arose during production thereof. These substrate boards, the dimensions of which are about 5.60 m×2 m, are stacked before they are introduced into the coating operation that follows. In a first step, the surface of the press skin can be subjected to grinding, or the press skin can to some extent be removed from the upper surface by grinding. If the underside of the substrate board also has a press skin, again the surface of this press skin can be subjected to grinding, or this press skin can at least to some extent be removed by grinding. However, it is not essential that the surface of the press skin is subjected to grinding, or that the press skin is removed by grinding. The press skin can also remain untreated. However, the minimal requirement is that the surface is dust-free for further treatment, and it is therefore sometimes necessary to clean same. The substrate board thus pretreated is then transported under an infrared source, and is thus heated. A base coat made of a melamine-based liquid resin is applied to the press skin of the substrate board, whereupon the resin penetrates at least to some extent into the upper peripheral layer of the upper side of the substrate board, and thus at least to some extent penetrates into the press skin and improves the quality thereof. Said base coat is then dried. It is preferable here to use a nozzle dryer, under which the substrate board is passed. It is also optionally possible to use an infrared source.

A digital printer, which is preferably an inkjet printer, is then used to apply a water-based base color, instead of a primer, to the dried base coat. The base color has white pigmentation, and is applied in only a single layer to the base coat. The size and number of the color dots from the digital printer can be adjusted, and it is thus possible to achieve precise adjustment of the quantity of ink required to produce a coherent surface as primer layer that is uniformly white and therefore is immediately suitable for the subsequent decorative print effect. This primer layer is then dried, and again here it is preferable to use a nozzle dryer, or optionally an infrared source, below which the board is passed.

It is preferable that a transparent primer for the subsequent decorative print effect is applied as print base to the dried base color layer.

After the drying process, the whiteness level of the base color layer is measured, so that the decorative print effect or the printer used for the decorative print effect can, where appropriate, be selected appropriately for the whiteness level. The decorative effect is then printed onto the optionally applied and dried primer layer. Printing units for this purpose can be composed of a plurality of printing rolls arranged in series which print different inks onto the material. It is preferable that a decorative wood effect is printed onto the material by four-color printing, but it is also possible here to provide any other type of decorative effect. It is also possible, instead of use of printing rolls, to use a digital printer, preferably an inkjet printer, which can apply the decorative effect in a single layer. The decorative layer is then dried. Here again, it is preferable to use an infrared source, below which the substrate board is passed.

A protective covering layer made of a water-based melamine resin is applied, preferably in liquid form, to the dried decorative layer, and is then dried. The substrate boards thus coated can then first be stacked before they are introduced to a further coating process. The dried protective covering layer here is intended to protect the decorative layer when the boards are stacked on top of one another. In a subsequent operation the substrate boards thus coated can then be coated with a liquid overlay, e.g. a sealing layer, composed of a liquid melamine-based resin, and the entire coating structure can then be pressed with the substrate board in a short-cycle press at high pressure and high temperature to give a finished laminate. This liquid resin can have been enriched with abrasion-resistant particles and cellulose fibers.

If no intermediate stacking of the substrate boards is necessary, the protective covering layer applied on the decorative layer can be omitted, and the liquid overlay can be applied immediately to the decorative layer.

Coating of the substrate board with the liquid overlay is described by way of example in EP 2 338 693 B1. The upper side and the underside of the wooden board are first cleaned. Dust and other contaminants which have accumulated on the relevant sides of the wooden board during storage or preceding steps of production are thus reliably removed in the first process step. This is important in order to ensure that required resin layers, even those that are very thin, are applied uniformly and homogeneously to the upper side or underside, and that no uneven area or inclusions occur in said layers. A first upper resin layer, comprising corundum particles, is then applied to the cleaned surface. The corundum particles in the first upper resin layer increase the abrasion resistance of said layer. This is of the greatest importance in particular for the use as floor panel, in order to provide resistance to the loads to which a floor panel is exposed. The corundum here by way of example takes the form of a mixture of conventional silanized corundum particles of varying grain size, and can easily be added to the resin. Here again, it is preferable to use a water-based melamine resin. A first lower corundum-free resin layer is applied to the underside of the wooden board, thus compensating the tensile forces to which the wooden board is subject by virtue of the first upper resin layer. The first lower resin layer can be a colored layer. Additives can have been added to both resin layers, examples being hardeners, wetting agents, and release agents. The first upper resin layer and the first lower resin layer are then dried in order to ensure trouble-free application of a following resin layer. The drying process takes place by way of example under a nozzle dryer, using hot air, or under an infrared source, whereupon the resin dries and the chemical crosslinking reaction of the melamine resin is terminated. As explained above, infrared sources can be used for the drying process here. During the drying of the resin, the chemical crosslinking reaction is terminated, and water is removed from the coating composition until the residual moisture content of same has been adjusted to about 3% to 6%. A second resin layer is then applied to the first upper and lower resin layer, and the resin layer applied to the upper side here comprises cellulose. The second resin layers, too, are then dried to a residual moisture content of from 3% to 6%. A third resin layer can then be applied, and the resin layer applied to the upper side here can comprise glass particles. The third resin layer then applied to the upper side and the underside of the substrate board is likewise dried to a residual moisture content of from 3% to 6%. The resultant layer structure is then pressed with the substrate board with exposure to pressure and heat in a short-cycle press.

The cellulose present in the second upper resin layer is present in commercially available fibers, which likewise can be added to the resin layers that are to be applied. The glass introduced in the third upper resin layer takes the form of commercially available glass microspheres. Again, these can easily be stored and introduced into the resin layer that is to be applied. The resin layers applied to the underside of the wooden board can be colored layers. Additives such as hardeners, wetting agents, and release agents can be added to all of the resin layers. The drying process to a residual moisture content of from 3% to 6% suppresses the process of crosslinking of the resin layers applied. During the subsequent pressing process with exposure to pressure and heat, the resin layers melt, and the crosslinking process continues. This ensures that crosslinking takes place not only within the individual resin layers but also between these layers, thus allowing pressing to give a large laminate. The operating pressure of conventional short-cycle presses is by way of example from 30 bar to 60 bar, the temperature at the surface of the wood material therein is by way of example 165° C., and the process time thereof is by way of example from 6 s to 12 s. The decorative effect is involved here in the crosslinking of the applied melamine resin layers. This means that the decorative effect is enclosed into the resin layers. If structured press plates are used, it is possible that, in addition to the decorative effect, structures are also embossed into the resin layers. These can be substantially in register with the decorative effect. In this case the term embossed-in-register structure is used.

It is preferable that the third upper resin layer comprises a proportion of 20% of glass particles. About 5% of cellulose has proven to be advantageous for the second upper resin layer. The first upper resin layer in particular comprises 2% of corundum particles.

The quantity applied of the upper resin layers and of the lower resin layers is advantageously from 20 g/m$^2$ to 50 g/m$^2$. Application of an equal quantity of the respective melamine resin layers applied on the upper side and underside at the same time ensures balancing of the tensile forces that arise from the applied layers during the drying process, and that act on the wooden board. The layer structure and the respective layer thickness of the counterbalancing material applied to the underside of the wooden board therefore correspond precisely to those of the layer sequence applied on the upper side. The primer layer and decorative layer on the upper side do not generate any tensile forces that require compensation. At the same time, the small quantity applied, from 20 g/m$^2$ to 50 g/m$^2$, ensures that, in particular on the underside of the substrate board, no curtaining occurs. The upper resin layers and the lower resin layers can comprise a 60% synthetic resin solution.

A device for the finishing of a decorated wooden board comprises the following:

a) a first double application device, b) a first drying device arranged downstream of the first double application device in a processing direction, c) a second double application device arranged downstream of the first drying device in processing direction, d) a second drying device arranged downstream of the second double application device in processing direction, e) at least one third double application device arranged downstream of the second drying device in processing direction, f) at least one third drying device arranged downstream of the at least one third double application device in processing direction, and g) a short-cycle press, where each double application device comprises an upper application device for the application of a resin layer to the upper side of the wooden board, and a lower application device for the application of a resin layer to the underside of the wooden board, and each upper application device and each lower application device has a mixing container in which the respective resin to be applied can be mixed with at least one addition.

The wooden boards requiring finishing, and provided with the decorative effect, are introduced into a device of this type. In the at least three double application devices, upper side and underside of the wooden board are simultaneously coated with a resin layer. This reduces production time and thus reduces production costs. The dryers which are provided downstream of the double application devices in which the freshly coated wooden boards are dried to the desired residual moisture content, for example by hot air, permit fast application of the respective first resin layer and suppress the crosslinking process of the applied resin layers at an early stage. There is no longer any requirement for intermediate storage of the coated wooden boards in order to dry the resin layers, or for turning of the wooden boards in order that the other side is also coated.

Because not only each upper application device but also each lower application device has a mixing container in which the respective resin to be applied can be mixed with the desired additions, it is in particular possible to achieve rapid switching between different product requirements, for example the desired abrasion class. There is no lengthy reengineering or holding of large quantities of various resin-additive mixtures in inventory. This markedly reduces not only the quantities of materials that have to be held in inventory but also the space required for the plant. At the same time, this also permits rapid and uncomplicated modification for different product properties, for example surface glass, acid resistance, or abrasion resistance. It is moreover also possible to use highly reactive resin mixtures, because a continuous operation takes place, and there is no longer any need to hold the coated wooden boards in intermediate storage. The cycle times of the short-cycle press are thus also markedly shortened and again this reduces production costs.

A device preferably has a feed battery with a plurality of feed containers in which the resin to be applied and the additions can be stored separately from one another, and ingoing lines from the feed containers to the mixing containers. The resin and the additions can thus be passed separately from one another into the mixing containers, and mixing to give the desired resin layer to be applied can be delayed until said materials reach said containers.

The device can in particular have a control system which is equipped to control the quantity of the resin passed through the ingoing lines into the mixing container, and of the additions. Automatic adaptation for a variety of product properties and application quantities, and a variety of additions, is thus rendered possible.

Each upper application device and each lower application device here can be an applicator roll unit. This ensures a layer thickness that is constant and finely adjustable. Furthermore, the layers applied by this method are very homogeneous and uniform.

There can be peristaltic pumps provided to pump the content of the mixing containers to the respective upper and lower application devices. The resultant increase in service time of the device, in comparison with the use of membrane pumps, is up to 20-fold. The hoses of the peristaltic pumps can moreover be replaced easily and rapidly by a quick-change system when necessary, with a resultant marked reduction in the maintenance times and repair times for the device.

Arranged upstream of each double application device there can preferably be, for the wooden board, at least one device that prevents upward movement. It is thus possible to eliminate any deformation that may have arisen in the wooden board during the production process, and to achieve precise and reproducible introduction of the wooden board that is to be coated into the respective double application device.

The wooden boards can be conveyed within the device by using toothed-plate conveyor equipment in the form of toothed-plate conveyor chains which are themselves robust and reliable and ensure that the coated wooden board has high surface quality. Cleaning brushes can be used for automatic cleaning of the toothed plates.

Rollers are used here for transport of a wooden board from a double application device to the conveyor chain and vice versa. The device described above for preventing upward movement, taking the form of rollers, is additionally used during input into a double application device or a dryer.

A device for the finishing of a wooden board can also have other double application devices which can increase the total layer thickness and also the number, and the proportions, of the functional additions. It is thus also possible to produce products in higher usage classes. This also applies to the process of the invention, where likewise more than three resin layers can be applied to the upper side and underside of the wooden board.

If an electrical, in particular computer-assisted, control system is used to control a device described here, high reproducibility of the applied resin layers can be achieved, because not only the mixing proportions of resin and additions but also the temperature control equipment, for example for the dryers and for the short-cycle press, are subject to automatic control. It is thus possible to achieve a high quality standard of the resultant products. It is moreover possible that various types of curvature of the wooden board, which can by way of example arise through application of the various base coat layers and decorative layers, are compensated automatically via control of the quantities applied on the upper side and/or underside.

The wooden board thus finally coated can then be used to produce individual floor panels, in that the wooden board is correspondingly divided. On the opposite lateral edges of the divided panels, connection means and interlocking means are then provided by milling, so that a plurality of panels can be connected to one another without use of glue and interlocked with one another (click panels).

The substrate board is preferably MDF, HDF, or particle board. The thickness of the substrate board is preferably from 4 mm to 12 mm, in particular 5.8 mm. The thickness of the press skin is about 0.2 mm. The wettability of the surface of the surface of the substrate board in press-finished condition is adjusted in that, before the pressing process, it is possible to apply an additive to the upper side of the cake of wood material. This additive is then preferably applied immediately before input of the cake of wood material into the heated press (for example a Conti press). The additive can be a surfactant or can be composed of surfactants and of other constituents. In particular, it is in liquid form. Other materials that can be added to the additive, alongside surfactants, are biocides, stabilizers, and/or polymers. The proportion of surfactants is preferably greater than 90%. Practical experiments have shown that a good effect is achieved when a quantity of from 1 to 30 $mg/m^2$ of the additive is uniformly distributed onto the surface of the cake of wood material.

Once the substrate board has been divided and the connection means and interlocking means have been applied by milling, a plurality of panels can be assembled in a pack.

What is claimed is:

1. A process for production of decorated wooden boards comprising:

a) scattering of glued wood fibers or wood chips to give a cake of wood material, b) pressing of the cake of wood material at elevated temperature to give a substrate board which is provided in press-finished condition and, at least on one of an upper side thereof, has a press skin that arose during production thereof, c) application of a base coat made of a melamine-based liquid resin to the press skin, which is untreated, of the upper side of the substrate board, whereupon the resin penetrates at least to some extent into an upper peripheral layer of the substrate board, and thus at least to some extent penetrates into the press skin, d) drying of the base coat, e) application of a base color to the base coat, f) drying of the base color, g) in order to produce a decorative effect, application of at least one water-based printing ink enriched with coloring pigments to the base color which is dried, h) drying of the decorative effect, i) application, to the decorative effect, of a sealing system made of at least one melamine-based resin, j) drying of the sealing system, and k) pressing of the substrate board with the base coat that has been applied on an upper side, the base color, the decorative effect, and the sealing system, and also with a counterbalancing material that has been applied to an underside, with exposure to pressure and heat, to form a laminate, wherein the base color used comprises a water-based ink which is applied by a digital printer to the base coat which is dried, and the sealing resin is applied in liquid form.

2. The process as claimed in claim 1, wherein the base color is applied to the base coat in a plurality of individual steps, and the base color that is applied to the base coat in the plurality of individual steps is dried after each step.

3. The process as claimed in claim 1, wherein the ink of the base color has white pigmentation.

4. The process as claimed in any of claim 1, wherein the decorative effect is applied by a digital printer.

5. The process as claimed in claim 4, wherein the decorative effect is applied in only a single layer.

6. The process as claimed in claim 1, wherein, as print base for the decorative effect, a primer is applied to the base color.

7. The process as claimed in claim 6, wherein the primer is transparent.

8. The process as claimed in claim 1, wherein the liquid resin for the base coat and the sealing system is aqueous.

9. The process as claimed in claim 1, wherein the resin forming the sealing system is enriched with abrasion-resistant particles, glass, and/or cellulose.

10. The process as claimed in claim 1, wherein during the pressing of the cake of wood material a surface structure is formed.

11. The process as claimed in claim 10, wherein the surface structure is at least to some extent brought into register with the decorative effect.

12. A panel made of a wooden board, produced as claimed in claim 1, with features comprising:

a) an upper side, an underside, and two pairs of opposite lateral edges, b) the upper side and the underside of the core have a press skin which arose during the pressing process, c) applied at least to the press skin on the upper side: a base coat layer, an ink layer composed of white ink dots, at least one decorative layer and one abrasion-resistant layer, d) applied on the underside of the core, there are a base coat layer and a layer of counterbalancing material, e) the base coat layer has penetrated at least to some extent into the press skin on the upper side, and f) on the opposite lateral edges there are connection means and interlocking means provided for connection of a plurality of panels without use of glue.

13. The panel as claimed in claim 12, wherein there is a transparent primer layer arranged between the ink layer and the decorative layer.

14. The panel as claimed in claim 12, wherein the wooden board is an MDF, HDF, or particle board.

15. The process as claimed in claim 1, wherein the base color has white pigmentation and is applied in only a single layer with a single dryer drying the base color.

16. The process as claimed in claim 15, wherein the base color is applied by another digital printer.

17. The process as claimed in claim 16, wherein a size and number of color dots from the other digital printer can be adjusted, to achieve precise adjustment of a quantity of ink required to produce a coherent surface as primer layer that is uniformly white and is immediately suitable for an application of the decorative effect.

18. The process as claimed in claim 17, wherein the base coat is dried by a nozzle dryer, under which the substrate board is passed.

19. The process as claimed in claim 18, further comprising:

applying a protective covering layer made of a water-based melamine resin to a dried decorative effect;

drying the protective covering layer; and stacking the substrate board on another substrate board that have the protective covering layer before it is introduced to a further coating process.

* * * * *